US005770043A

United States Patent [19]

Ellis et al.

[11] Patent Number: 5,770,043

[45] **Date of Patent: *Jun. 23, 1998**

[54] INTEGRATED STAGED CATALYTIC CRACKING AND HYDROPROCESSING PROCESS

[75] Inventors: Edward S. Ellis, Basking Ridge; Ramesh Gupta, Berkeley Heights; Martin G. Bienstock, Succasunna, all of N.J.

[73] Assignee: Exxon Research and Engineering Company, Florham Park, N.J.

[ * ] Notice: The term of this patent shall not extend beyond the expiration date of Pat. No. 5,582,711.

[21] Appl. No.: 697,381

[22] Filed: Aug. 23, 1996

Related U.S. Application Data

[63] Continuation-in-part of Ser. No. 292,625, Aug. 17, 1994, Pat. No. 5,582,711.

[51] Int. Cl.[6] ..... C10G 51/02

[52] U.S. Cl. ..... 208/76; 208/72; 208/74; 208/77; 208/78; 208/80; 208/89; 208/100; 208/57

[58] Field of Search ..... 208/61, 57, 72, 208/76, 74, 77, 78, 80, 89, 100

[56] References Cited

U.S. PATENT DOCUMENTS

| | | | |
|---|---|---|---|
| 2,791,541 | 5/1957 | Thompson et al. | 196/49 |
| 2,953,513 | 9/1960 | Langer | 208/56 |
| 2,956,003 | 11/1960 | Marshall et al. | 208/74 |
| 2,981,674 | 4/1961 | Good | 208/70 |
| 3,287,254 | 11/1966 | Patterson | 208/68 |
| 3,896,024 | 7/1975 | Nace | 208/74 |
| 3,928,172 | 12/1975 | Davis et al. | 208/77 |
| 4,191,635 | 3/1980 | Quick et al. . | |
| 4,551,229 | 11/1985 | Pecoraro | 208/76 |
| 4,565,620 | 1/1986 | Montgomery et al. | 208/80 |
| 4,585,545 | 4/1986 | Yancey et al. | 208/74 |
| 4,606,810 | 8/1986 | Krambeck et al. | 208/74 |
| 5,152,883 | 10/1992 | Melin et al. | 208/61 |
| 5,582,711 | 12/1996 | Ellis et al. | 208/76 |

*Primary Examiner*—Helane Myers
*Attorney, Agent, or Firm*—James H. Takemoto

[57] ABSTRACT

Disclosed is a catalytic cracking process which includes more than one catalytic cracking reaction step. The process integrates a hydroprocessing process step between the catalytic cracking reaction steps in order to maximize olefins production, mid-distillate quality and naphtha octane level in the cracked products. Preferably, a first cracked hydrocarbon product is obtained from a first cracking stage and separated into a mid-distillate and gas oil containing fraction having an initial boiling point of at least 300° F., the distillate and gas oil containing fraction is hydroprocessed, and a naphtha fraction and a gas oil containing bottoms fraction of the hydroprocessed material are cracked in a second cracking stage.

9 Claims, 1 Drawing Sheet

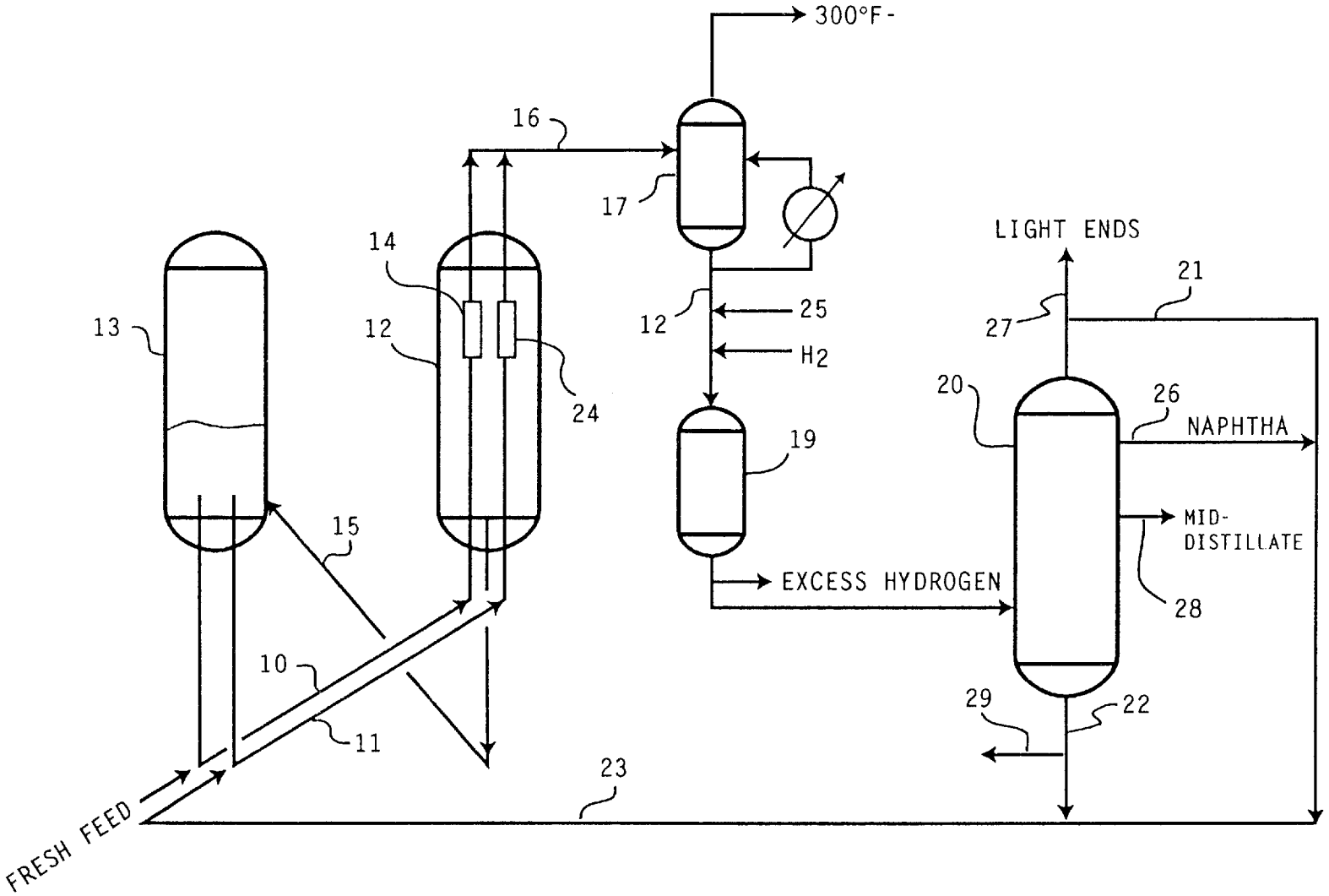
300°F-
LIGHT ENDS
NAPHTHA
MID-DISTILLATE
EXCESS HYDROGEN
H2
FRESH FEED
10
11
12
13
14
15
16
17
19
20
21
22
23
24
25
26
27
28
29

INTEGRATED STAGED CATALYTIC CRACKING AND HYDROPROCESSING PROCESS

CROSS REFERENCE TO RELATED APPLICATIONS

This application is a continuation-in-part of U.S. application Ser. No. 08/292,658 filed Aug. 17, 1994, abandoned now U.S. Pat. No. 5,582,711.

FIELD OF THE INVENTION

This invention relates to a staged catalytic cracking process which includes more than one catalytic cracking reaction step. In particular, this invention relates to a staged catalytic cracking process which integrates a hydroprocessing step between the catalytic cracking reaction steps.

BACKGROUND OF THE INVENTION

Staged catalytic cracking reaction systems have been introduced to improve the overall octane quality of gasoline. In recent times, however, octane problems have been minimized and environmental constraints have had a larger impact on the refiner. As a result, the known staged catalytic cracking processes are not sufficiently effective in concomitantly meeting environmental constraints and maintaining a high quality octane gasoline product.

U.S. Pat. No. 5,152,883 discloses a fluid catalytic cracking unit which includes two catalytic cracking reaction steps in series. After hydrocarbon feed is cracked in a first catalytic cracking reaction step, light hydrocarbon and gasoline products are removed from the product stream and the heavier product portion is hydrotreated. Following hydrotreating and further gasoline product removal, the heavier hydrotreated product is cracked in a second catalytic cracking step. The gasoline products are removed and the heavier products are recycled into the hydrotreating process.

Rehbein et al., Paper 8 from Fifth World Petroleum Progress, Jun. 1–5, 1959, Fifth World Petroleum Congress, Inc., New York, pages 103–122 (which corresponds to U.S. Pat. No. 2,956,003, Marshall et al.), disclose a two stage catalytic cracking process which uses a short contact time riser as the first stage. The first stage is described as being designed to give 40–50 vole conversion. The second stage is a dense bed system that is stated as being designed to charge gas oils from the first stage along with a recycle stream to give overall conversions of 63–72 vol. %, although the unit is said to have been run at low enough charge rates to achieve total conversions from 65–90 vol. %.

As the prior art demonstrates, known catalytic cracking processes which have been integrated with hydrotreating processes are effective in significantly increasing the octane level of the gasoline product. The known systems, however, increase octane by sacrificing the quality of distillates which can be used as diesel or fuel oil. In addition, the known processes produce a relatively high quantity of light saturated vapor products as a result of inefficient hydrogen transfer of hydrogen from the heavier cracked products back to lighter olefin products. By minimizing the negative effects of this type of hydrogen transfer, a greater quantity of olefins product can be produced, and these olefins are made available for further conversion into oxygenates and useful polymer materials. It is, therefore, desirable to obtain a catalytic cracking process which maximizes olefins production, distillate quality and octane level.

SUMMARY OF THE INVENTION

In order to overcome problems inherent in the prior art, the present invention provides a catalytic cracking process comprising the continuous steps of: (a) contacting a hydrocarbon with cracking catalyst under catalytic cracking conditions forming a first cracked hydrocarbon product; (b) separating from the first cracked hydrocarbon product a mid-distillate and gas oil containing bottoms fraction having an initial boiling point of at least 300° F.; (c) hydroprocessing the mid-distillate and gas oil containing bottoms fraction under hydroprocessing conditions forming a hydroprocessed product; (d) separating from the hydroprocessed product a hydroprocessed mid-distillate fraction, a hydroprocessed naphtha fraction, and a hydroprocessed gas oil containing bottoms fraction; (e) contacting the hydroprocessed naphtha fraction and the hydroprocessed gas oil containing bottoms fraction with cracking catalyst under catalytic cracking conditions forming a second cracked hydrocarbon product; and combining the second cracked hydrocarbon product with the first cracked hydrocarbon product for continued separation and hydroprocessing of the distillate and gas oil containing bottoms fraction.

In one preferred embodiment, less than 50 vol. % of the first cracked hydrocarbon product formed in step (a) has a boiling point of less than or equal to 430° F. It is further preferred that at least 60 vol. %, preferably 75 vol. % of the combined first and second cracked hydrocarbon products have a boiling point of less than or equal to 430° F.

It yet another preferred embodiment, the catalytic cracking conditions of step (c) include a reaction temperature that is at least equal to that used under the catalytic cracking conditions of step (a). More preferably, the distillate and gas oil containing fraction and the cracking catalyst are contacted at a temperature which is up to 100° F. higher than that used in step (a). More particularly, the hydrocarbon is contacted with the cracking catalyst at a temperature of 900°–1150° F.

In still another preferred embodiment, the hydrocarbon is contacted with a zeolite cracking catalyst for less than five seconds. More preferably, the hydrocarbon is contacted with the zeolite catalyst for 1–2 seconds.

In another preferred embodiment of the invention, the second cracked hydrocarbon product is combined with the hydroprocessed product prior to separating the hydroprocessed naphtha fraction and the hydroprocessed gas oil containing bottoms fraction from the hydroprocessed product. It is also preferred that the hydroprocessed naphtha fraction, the hydroprocessed gas oil containing bottoms fraction, and the cracking catalyst are contacted at a temperature of 950°–1250° F. More preferably, the hydroprocessed naphtha fraction, the hydroprocessed gas oil containing bottoms fraction, and the cracking catalyst are contacted at a temperature which is up to 100° F. higher than that used in step (a).

It is further preferred that the hydroprocessed naphtha fraction have a final boiling point of less than 430° F. In addition, it is preferred that the hydroprocessed gas oil containing bottoms fraction have an initial boiling point of at least 600° F. The hydroprocessing reactions can be conducted in fixed or moving bed reactors.

BRIEF DESCRIPTION OF THE DRAWING

The present invention will be better understood by reference to the Detailed Description of the Invention when taken together with the attached drawing, wherein:

FIG. 1 is a schematic representation of a preferred embodiment of the invention.

DETAILED DESCRIPTION OF THE INVENTION

Catalytic cracking is a process which is well known in the art of petroleum refining and generally refers to converting at least one large hydrocarbon molecule to smaller hydrocarbon molecules by breaking at least one carbon to carbon bond. For example, a large paraffin molecule can be cracked into a smaller paraffin and an olefin, and a large olefin molecule can be cracked into two or more smaller olefin molecules. Long side chain molecules which contain aromatic rings or naphthenic rings can also be cracked.

It has been found that the quantity of light olefins product and the quality of distillate product that is formed during the catalytic cracking process can be improved by initially incorporating a short contact time reaction step into the overall catalytic cracking process. After the short contact time reaction step, a distillate and gas oil containing bottoms fraction is separated from the product portion, and the distillate and gas oil containing bottoms fraction is reprocessed at a higher intensity relative to that used in the short contact time reaction step.

According to this invention, product yield and quality are further enhanced by integrating a hydroprocessing step into the staged catalytic cracking process. Preferably, the hydroprocessing step is included between the reaction stages.

In essence, the current invention takes advantage of an integration in which key chemistry synergies between FCC and hydrogenation technologies are exploited. A first FCC stage is operated at low enough severity, preferably with short contact time, to achieve high selectivity to olefin production while preserving sufficient aliphatic character in the unconverted mid-distillate and bottoms fractions to make acceptable quality distillate for distillate fuel blendstocks and an acceptable quality bottoms stream which enables moderate-severity hydroprocessing. At the same time, the first FCC step accomplishes two important benefits with respect to subsequent hydroprocessing; the most polar species in the feed are allowed to deposit on the FCC catalyst, and are subsequently burned off the FCC catalyst in the regeneration step, providing heat for the endothermic FCC reactor chemistry. The presence of these polar species would otherwise result in severe hydroprocessing severity requirements (i.e., high pressure, large reactor volume) if the feed were hydroprocessed before the first FCC stage. The second benefit derived from the first FCC stage is simple volume reduction, that is, in the process of catalytically cracking the most easily cracked molecules in the FCC feed, the volume of feedstock remaining to be hydroprocessed is greatly reduced, and it is reduced to that population of molecules which are not easily converted in FCC, i.e., those molecules that will most benefit from the hydroprocessing chemistry which can increase FCC feed crackability. Thus, the first FCC step selectively prepares a reduced-volume feed to hydroprocessing which contains a reduced amount of hydroprocessing catalyst poisons or inhibitors. As a result, the hydroprocessing step can efficiently be directed to the task of facilitating and enhancing the selectivity of subsequent FCC conversion.

A novel feature is to include the entire boiling range of unconverted bottoms from the first FCC step in the feed to the hydroprocessing reactor, as this bottoms stream, because of the intentional low-intensity operation of the first FCC stage, is quite suitable as a hydroprocessing feedstock. As a result of this selective conditioning of the hydrotreater feed, the hydroprocessing operating severity, e.g., operating pressure and reactor volume, is much less than would be considered necessary for hydroprocessing of a conventional FCC bottoms stream. The hydroprocessing reactor conditions and catalyst can be selected to provide sufficient hydrogenation and/or hydrocracking to meet a wide range of operating objectives for the combined FCC-hydrotreating complex. A primary benefit of the hydroprocessing of the first FCC stage bottoms is to interrupt the FCC chemistry at the point where there would be a significant decline in feed crackability upon further FCC processing, and to selectively insert hydrogen at that point into those unconverted molecules. Then subsequent FCC reactions can resume with a feedstock of increased crackability. By splitting the catalytic cracking into two stages, with hydrogen addition between stages, the right amount of hydrogen can be added to for example maximize the yield of light olefin species, e.g. butenes, propylene, and ethylene, in the subsequent FCC stage. With interstage hydroprocessing, both FCC stages could be operated at short contact times, to maximize light olefin yield. A related synergy in this approach is that it enables additional production of higher-hydrogen content mid-distillates, e.g., diesel and jet fuel components, by enabling short-contact time catalytic cracking, which limits hydrogen transfer reactions in the FCC reactor, that would otherwise increase dehydrogenation of distillates and hydrogenation of light olefins. Finally, the second FCC stage can perform the desired conversion of a reduced volume of more crackable FCC feed from the hydroprocessing step. Without the interstage hydroprocessing of the bottoms, the severity required of the second FCC stage would be considerably higher, greatly reducing flexibility for achieving high yields of light olefins and high quality distillates, and increasing the yield of second-stage bottoms byproduct.

A preferred embodiment further optimizes the utilization of the integrated hydroprocessing step by routing heavy naphtha, e.g., boiling above about 300° F. and the adjacent higher boiling mid-distillate produced in the catalytic cracking steps to the integrated hydroprocessing unit, and subsequently routing the hydroprocessed naphtha fraction to the second FCC step for re-cracking. As a result, the integrated hydroprocessing unit provides a means to facilitate conversion of heavy catalytically cracked naphtha while also providing desulfurization of diesel product and improving the crackability of the unconverted bottoms feed to subsequent FCC.

As described herein, a staged catalytic cracking process is a catalytic cracking process which includes at least two catalytic cracking reaction steps, preferably performed in series. These reaction steps preferably take place in a fluid catalytic cracking system, which preferably comprises two or more main reaction vessels, two are more riser reactors which connect to one main reaction vessel, or a combination of multiple risers and reactor vessels.

In the catalytic cracking process of this invention, the hydrocarbon feed is preferably a petroleum hydrocarbon. The petroleum hydrocarbon is preferably a hydrocarbon fraction having an initial boiling point of at least about 400° F., more preferably at least about 600° F. As appreciated by those of ordinary skill in the art, however, the initial and final boiling points of petroleum hydrocarbons and hydrocarbon fractions as defined herein are not intended to be precise and include some degree of variability, particularly with regard to large commercial processes in which some degree of variability is acceptable. Hydrocarbon feeds which are included in the above range, however, are also understood to include such hydrocarbon fractions as gas oils, thermal oils, residual oils, cycle stocks, topped and whole crudes, tar sand oils, shale oils, synthetic fuels, heavy hydrocarbon fractions derived from the destructive hydrogenation of coal, tar, pitches, asphalts, and hydroprocessed feed stocks derived from any of the foregoing.

The hydrocarbon feed is preferably introduced into a riser which feeds a catalytic cracking reactor vessel. Preferably, the feed is mixed in the riser with catalytic cracking catalyst that is continuously recycled.

The hydrocarbon feed can be mixed with steam or an inert type of gas at such conditions so as to form a highly atomized stream of a vaporous hydrocarbon-catalyst suspension. Preferably, this suspension flows through the riser into a reactor vessel.

Within the reactor vessel, the catalyst is separated from the hydrocarbon vapor to obtain the desired products, such as by using cyclone separators. The separated vapor comprises the cracked hydrocarbon product, and the separated catalyst contains a carbonaceous material (i.e., coke) as a result of the catalytic cracking reaction.

The coked catalyst is preferably recycled to contact additional hydrocarbon feed after the coke material has been removed. Preferably, the coke is removed from the catalyst in a regenerator vessel by combusting the coke from the catalyst under standard regeneration conditions. Preferably, the coke is combusted at a temperature of about 900°–1400° F. and a pressure of about 0–100 psig. After the combustion step, the regenerated catalyst is recycled to the riser for contact with additional hydrocarbon feed. Preferably, the regenerated catalyst contains less than 0.4 wt. % coke, more preferably less than 0.1 wt. % coke.

The catalyst which is used in this invention can be any catalyst which is typically used to catalytically "crack" hydrocarbon feeds. It is preferred that the catalytic cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM#D3907-8). Compounds such as those disclosed in Greensfelder, B. S., et al., Industrial and Engineering Chemistry, pp. 2573–83, November 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as α-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite.

In the staged catalytic cracking process incorporated into this invention, hydrocarbon feed is subjected to a first catalytic cracking reaction step, at least a portion of the product of the first reaction step is separated, and the separated portion is subjected to at least one additional catalytic cracking reaction step. Separation is preferably achieved using known distillation methods.

According to this invention, after a hydrocarbon feed undergoes the first catalytic cracking reaction step, it is preferable to separate a mid-distillate and gas oil containing bottoms fraction from the product of the cracking reaction. The mid-distillate and gas oil containing bottoms fraction is preferably a petroleum distillate fraction having an initial boiling point of at least 300° F. After hydroprocessing, it is preferable to separate from the hydroprocessed product a hydroprocessed naphtha fraction and a hydroprocessed gas oil containing bottoms fraction. The hydroprocessed naphtha fraction and the hydroprocessed gas oil containing bottoms fraction are then contacted with cracking catalyst forming a second cracked product. The remaining lighter product portion of the first catalytic cracking reaction and an intermediate hydroprocessed mid distillate fraction are sent to storage or subjected to further processing in other refinery processing units.

As known to those of ordinary skill in the art, a naphtha fraction refers to hydrocarbons which have a boiling point range of about 90°–430° F. A gas oil containing bottoms fraction is a hydrocarbon fraction that has an initial boiling point of at least about 600° F. A mid-distillate fraction, therefore, represents a hydrocarbon composition containing hydrocarbons that have a boiling point range between the naphtha fraction and the gas oil containing bottoms fraction although there is some overlap. The mid-distillate fraction preferably has an initial boiling point of about 300° F., preferably about 350° F., and a final boiling point of about 800° F., preferably 700° F.

It is preferred in this invention that the mid-distillate and gas oil containing bottoms fraction be hydroprocessed prior to being subjected to any additional catalytic cracking steps. The mid-distillate and gas oil containing bottoms fraction is hydroprocessed by passing the fraction over a hydroprocessing catalyst in the presence of a hydrogen containing gas under hydroprocessing conditions.

As used herein, hydroprocessing includes both hydrotreating and mild hydrocracking, with mild hydrocracking indicating that sufficient cracking of 650° F.+ feed has occurred such that there is a yield of greater than 15 wt. % and less than 50 wt. % of 650° F.– hydrocarbon material from the cracking reaction. As is known by those of skill in the art, the degree of hydroprocessing can be controlled through proper selection of catalyst as well as by optimizing operation conditions.

It is particularly desirable in this invention that the hydroprocessing step sufficiently saturate the aromatic rings to form more easily crackable naphthenic rings. It is also desirable that the hydroprocessing step convert unsaturated hydrocarbons such as olefins and diolefins to paraffins using a typical hydrogenation catalyst. Objectionable elements can also be removed by the hydroprocessing reaction. These elements include sulfur, nitrogen, oxygen, halides, and certain metals.

The hydroprocessing step of the invention is performed under hydroprocessing conditions. Preferably, the reaction is performed at a temperature of 400°–900° F., more preferably 600°–850° F. The reaction pressure is preferably 100–3000 psig, more preferably 500–2000 psig. The hourly space velocity is preferably 0.1–6 V/V/Hr, more preferably 0.3–2 V/V/Hr, where V/V/Hr is defined as the volume of oil per hour per volume of catalyst. The hydrogen containing gas is preferably added to establish a hydrogen charge rate of 500–15,000 standard cubic feet per barrel (SCF/B), more preferably 1000–5000 SCF/B.

The hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydrotreater feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Use of such a reactor would be especially beneficial in cases where the feedstocks include solids in excess of about 25 micron size, or contain contaminants which increase the propensity for foulant accumulation, such as olefinic or diolefinic species or oxygenated species. Moving bed reactors which utilize downward-flowing liquid and gas can also be applied, as they would enable onstream catalyst replacement.

The catalyst used in the hydroprocessing step can be any hydroprocessing catalyst suitable for aromatic saturation, desulfurization, denitrogenation or any combination thereof. Preferably, the catalyst is comprised of at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkenson.

The Group VIII metal is preferably present in an amount ranging from 2–20 wt. %, preferably 4–12 wt. %. Preferred Group VIII metals include Co, Ni, and Fe, with Co and Ni being most preferred. The preferred Group VI metal is Mo which is present in an amount ranging from 5–50 wt. %, preferably 10–40 wt. %, and more preferably from 20–30 wt. %.

All metals weight percents are given are on support. The term "on support" means that the percents are based on the weight of the support. For example, if a support weighs 100 g, then 20 wt. % Group VIII metal means that 20 g of the Group VIII metal is on the support.

Any suitable inorganic oxide support material may be used for the catalyst of the present invention. Preferred are alumina and silica-alumina. More preferred is alumina. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200, preferably, 70–150, and a surface area from 50–450 $m^2/g$.

In the staged catalytic cracking process of this invention, a short contact time reaction step is preferably included. In the short contact time reaction step, it is preferable that the hydrocarbon feed contacts the cracking catalyst under catalytic cracking conditions to form a first cracked hydrocarbon product, and the catalytic cracking conditions are controlled so that less than 50 vol. % of the first cracked hydrocarbon product has a boiling point below about 430° F. More preferably, catalytic cracking conditions are controlled so that 25–40 vol. % of the first cracked hydrocarbon product has a boiling point equal to or below about 430° F.

The 430° F. boiling point limitation is not per se critical, but is used to give a general indication of the amount of gasoline and high quality distillate type products that are formed in the short contact time reaction step. In the short contact time reaction step, therefore, it is desirable to initially limit the conversion to gasoline and high quality distillate type products. By controlling the conversion in this step, hydrogen transfer can be positively affected in any subsequent cracking step.

According to this invention, short contact time means that the hydrocarbon feed will contact the cracking catalyst for less than five seconds. In typical fluid catalytic cracking systems this means that the vapor residence time will be less than five seconds. Preferably, in the short contact time reaction step, the hydrocarbon feed will contact the cracking catalyst for 1–4 seconds.

The short contact time reaction step can be achieved using any of the known processes. For example, in one embodiment a close coupled cyclone system effectively separates the catalyst from the reacted hydrocarbon to quench the cracking reaction. See, for example, Exxon's U.S. Pat. No. 5,190,650, of which the detailed description is incorporated herein by reference.

Short contact time can be achieved in another embodiment by injecting a quench fluid directly into the riser portion of the reactor. The quench fluid is injected into the appropriate location to quench the cracking reaction in less than one second. See, for example, U.S. Pat. No. 4,818,372, of which the detailed description is incorporated herein by reference. Preferred as a quench fluid are such examples as water or steam or any hydrocarbon that is vaporizable under conditions of injection, and more particularly the gas oils from coking or visbreaking, catalytic cycle oils, and heavy aromatic solvents as well as certain deasphalted fractions extracted with a heavy solvent.

In yet another embodiment, short contact time can be achieved using a downflow reactor system. In downflow reactor systems, contact time between catalyst and hydrocarbon can be as low as in the millisecond range. See, for example, U.S. Pat. Nos. 4,985,136, 4,184,067 and 4,695,370, of which the detailed descriptions of each are incorporated herein by reference.

The particular catalytic cracking conditions used to achieve conversion to a product in which less than 50 vol. % of the product has a boiling point less than 430° F. are readily obtainable by those of ordinary skill in the art. Once the preferred particular cracking catalyst is chosen, the operations parameters of pressure, temperature and vapor residence time are optimized according to particular unit operations constraints. For example, if it is desired to use a zeolite type of cracking catalyst, the short contact time reaction step will typically be carried out at a pressure of 0–100 psig (more preferably 5–50 psig), a temperature of 900°–1150° F. (more preferably 950°–1050° F.) and a vapor residence time of less than five seconds (more preferably 2–5 seconds).

Regardless of the type of quenching step used to achieve the short contact time reaction, the catalyst is separated from the vapor to obtain the desired products according to the known processes, such as by using cyclone separators. The separated vapor comprises the cracked hydrocarbon product, and the separated catalyst contains a carbonaceous material (i.e., coke) as a result of the catalytic cracking reaction.

The products recovered from the short contact time reaction step are preferably separated so that a mid-distillate and gas oil containing bottoms fraction is recovered for hydroprocessing and reprocessing. Preferably, the mid-distillate and gas oil containing bottoms fraction contains a mid-distillate having an initial boiling point of at least 300° F.

After the mid-distillate and gas oil containing bottoms fraction is separated, it is preferably hydroprocessed, a hydroprocessed naphtha fraction and a hydroprocessed gas oil containing bottoms fraction are then separated from the hydroprocessed product and both of the hydroprocessed fractions are subjected to at least one subsequent cracking step with a cracking catalyst under catalytic cracking conditions which favor cracking of the hydrocarbons contained in the hydroprocessed fractions. Although not necessary, it is preferred in any subsequent cracking step following the hydroprocessing step the reaction temperature be at least equal to that used in the short contact time reaction step. The appropriate catalytic cracking conditions employed following the short contact time reaction step are preferably controlled so that the combined products of all of the cracking steps will yield an overall product in which at least 60 vol. %, preferably at least 75 vol. %, more preferably at least 85 vol. %, of the overall product has a boiling point of less than or equal to about 430° F.

In any cracking steps following the hydroprocessing step, the conditions which are used to achieve the desired overall product boiling point characteristics are readily obtainable by those of ordinary skill in the art and are optimized according to the needs of the specific operating unit. Since the same catalyst is generally used in the short contact time reaction step as in a subsequent cracking reaction step, it is preferred to increase slightly the severity of the reaction conditions in the subsequent reaction step. Preferably, this is done by increasing the temperature or vapor contact time, or both, in the subsequent reaction step, while maintaining reaction pressure similar to that in the first catalytic cracking step, although reaction pressure can be adjusted without changing temperature or vapor contact time. For example, when using a zeolite type of cracking catalyst, it is preferred to have a vapor residence time of less than 10 seconds, more preferably a vapor residence time of 2–8 seconds.

Depending upon the quality of the feed, the severity of hydroprocessing and the particular reaction equipment used, it can be desirable to increase the temperature of a subsequent catalytic cracking reaction step. Preferably, any temperature increase will be less than about 100° F. higher than in the first catalytic cracking reaction step and in a range of about 950°–1250° F.

Although it is preferred to slightly increase the severity of any cracking reaction subsequent to the initial short contact time reaction step, this is not necessary. In general, the more intense the hydroprocessing step, the less intense can be any subsequent cracking steps.

A preferred embodiment of the invention is shown in FIG. 1 in which the cracking reaction is carried out using dual risers 10, 11 and a single reactor 12, with the spent catalyst being regenerated in a single regenerator 13. Although a dual riser and single reactor design is shown as one preferred embodiment, the process of this invention can be carried out using more than one reactor or more than two risers.

In FIG. 1, fresh hydrocarbon feed is injected into the riser 10 where it contacts hot catalyst from the regenerator 13. The reaction is preferably quenched using a cyclone separator 14 to separate the hydrocarbon material from the spent catalyst. The spent catalyst falls through a stripper and standpipe and is carried through a return line 15 to the regenerator 13 where it is regenerated for further use.

Cracked hydrocarbon product is removed from the cyclone 14 by way of a line 16 which leads to a separation vessel 17. The separation vessel 17, preferably a fractionation vessel, is used to separate a mid-distillate and gas oil containing bottoms fraction from a relatively light gasoline and vapor containing fraction having a boiling point less than about 300° F. As stated above, operating conditions within the riser 10 are preferably maintained such that less than 50 vol. % of the cracked hydrocarbon product collected in the separation vessel 17 has a boiling point of less than or equal to 430° F.

The mid-distillate and gas oil containing bottoms fraction is removed from the separation vessel by way of a line 18. As the mid-distillate and gas oil containing bottoms fraction is transported through line 18, a hydrogen containing gas stream is injected at the desired rate, and the entire mixture is sent to a hydroprocessing reactor 19. The hydroprocessing reactor 19 contains a hydroprocessing catalyst and the hydroprocessing reaction is carried out under hydroprocessing conditions utilizing a hydroprocessing reactor which contains a fixed or moving bed of catalyst particles.

Following the hydroprocessing reaction, excess hydrogen is recovered and the hydroprocessed product is transported to a separation vessel 20. A hydroprocessed naphtha fraction is recovered by way of a line 26 and a hydroprocessed gas oil containing bottoms fraction is recovered by way of a line 22 for reprocessing by contacting with hot cracking catalyst in riser 11 by way of a line 23. A hydroprocessed mid-distillate product is recovered by way or line 28. The cracking reaction in riser 11 is quenched by separating the cracked products from the spent catalyst using a cyclone separator 24. The spent catalyst is combined with the spent catalyst that is separated using the cyclone separator 14, and is sent through the riser 15 to the regenerator 13 where it is regenerated for further use.

The second cracked hydrocarbon product is combined with the first cracked hydrocarbon product from cyclone separator 24. Preferably, the second cracked product is combined with the first cracked hydrocarbon product in line 16, and both products are sent to the separation vessel 17 for continuous separation of 300° F.− product and hydroprocessing of 300° F.+ product. After hydroprocessing, a high quality hydroprocessed mid-distillate fraction is removed from the hydroprocessed fractions, and the remaining material is reprocessed. A hydroprocessed light ends fraction is recovered by way of line 27. A portion of the hydroprocessed light ends fraction can be sent to the second catalytic cracking step by way of line 21. The light ends fraction refers to a $C_4$-having a bydrocarbon fraction having a boiling point less than about 60° F.

Because the hydroprocessing step removes undesirable contaminants and improves the quality of the feed to the riser 11, other petroleum distillate fractions can be combined with the gas oil containing bottoms fraction prior to hydroprocessing such as by line 25. These other petroleum distillate fractions include petroleum fractions which are generally high in contaminant content, and which would not be typically processed in a catalytic cracking reactor. An example of such petroleum distillate fractions includes heavy coker oil streams. A portion of the hydroprocessed bottoms in line 22 can be withdrawn as a purge stream via line 29. An alternate purge location in the system may also be used.

Having now fully described this invention, it will be appreciated by those skilled in the art that the invention can be performed within a wide range of parameters within what is claimed:

What is claimed is:

1. A catalytic cracking process for producing a high quality mid-distillate comprising the continuous steps of:

(a) contacting a hydrocarbon having an initial boiling point of at least about 400° F. with cracking catalyst under catalytic cracking conditions wherein the temperature is from 900° to 1150° F. and the catalyst contact time is less than 5 sec. forming a first cracked hydrocarbon product;

(b) conducting the first cracked product to a separator and separating from the first cracked hydrocarbon product an overhead naphtha and light ends fraction, and a mid-distillate and gas oil containing bottoms fraction having an initial boiling point of at least 300° F.;

(c) conducting the mid-distillate and gas oil containing bottoms fraction to a hydroprocessing reactor and hydroprocessing the mid-distillate and gas oil containing bottoms fraction under hydroprocessing conditions forming a hydroprocessed product;

(d) conducting the hydroprocessed product to a second separator and separating from the hydroprocessed product a hydroprocessed mid-distillate fraction, a hydroprocessed naphtha fraction and a hydroprocessed gas oil containing bottoms fraction;

(e) contacting the hydroprocessed naphtha fraction and the hydroprocessed gas oil containing bottoms fraction with cracking catalyst under catalytic cracking conditions wherein the temperature is from 950° to 1250° F. forming a second cracked hydrocarbon product; and (f) combining the second cracked hydrocarbon product from step (e) with the first cracked hydrocarbon product from step (a) and conducting the combined first and second cracked hydrocarbon products to the first separator for continued separation of the distillate and gas oil containing bottoms fraction and hydroprocessing of said fraction pursuant to step (c).

2. The catalytic cracking process of claim 1, wherein less than 50 vol. % of the first cracked hydrocarbon product formed in step (a) has a boiling point of less than or equal to 430° F.

3. The catalytic cracking process of claim 2, wherein at least 60 vol. % of the first and second cracked hydrocarbon products have an overall boiling point of less than or equal to 430° F.

4. The catalytic cracking process of claim 1, wherein the hydrocarbon is contacted with the zeolite catalyst for 1–2 seconds.

5. The catalytic cracking process of claim 1, wherein the second cracked hydrocarbon product is combined with the hydroprocessed product prior to separating the hydroprocessed naphtha fraction and the hydroprocessed gas oil containing bottoms fraction from the hydroprocessed product.

6. The catalytic cracking process of claim 1, wherein the hydroprocessed naphtha fraction has a final boiling point of less than 430° F.

7. The catalytic cracking process of claim 1, wherein the hydroprocessed gas oil containing bottoms fraction has an initial boiling point of at least 600° F.

8. The catalytic cracking process of claim 1 wherein the hydroprocessor is a trickle bed, countercurrent, moving bed, expanded bed or slurry bed type reactor.

9. The catalytic cracking process of claim 1 wherein the hydroprocessed naphtha fraction has an initial boiling point of greater than about 300° F.

* * * * *